United States Patent [19]

Dingethal et al.

[11] 4,278,693

[45] Jul. 14, 1981

[54] SHIPPER PACKAGE

[75] Inventors: Frank H. Dingethal; Edward Bartosek, both of Kitchener, Canada

[73] Assignee: J. M. Schneider Inc., Kitchener, Canada

[21] Appl. No.: 142,091

[22] Filed: Apr. 21, 1980

[51] Int. Cl.[3] ..... B65D 73/00; B65D 5/50; B65B 25/06

[52] U.S. Cl. ..... 426/129; 206/45.19; 206/45.33; 206/461; 206/471; 426/106; 426/130; 426/396

[58] Field of Search ..... 426/124, 129, 130, 396, 426/410, 412, 106, 127; 206/45.33, 45.19, 45.32, 461, 471, 497

[56] References Cited

U.S. PATENT DOCUMENTS

| | | | |
|---|---|---|---|
| 2,809,896 | 10/1957 | Pierson et al. | 206/45.33 |
| 3,047,404 | 7/1962 | Vaughan | 426/129 |
| 3,229,810 | 1/1966 | Goller et al. | 426/124 |
| 3,272,328 | 9/1966 | Krzyzanowski | 206/45.33 |
| 3,288,347 | 11/1966 | Commisso et al. | 206/45.33 |
| 3,833,742 | 9/1974 | Wetmore et al. | 426/129 |

FOREIGN PATENT DOCUMENTS

| | | | |
|---|---|---|---|
| 826036 | 10/1969 | Canada | 426/124 |
| 1281347 | 7/1972 | United Kingdom | 426/121 |

*Primary Examiner*—Steven L. Weinstein
*Attorney, Agent, or Firm*—Fetherstonhaugh & Co.

[57] ABSTRACT

A shipper package for shipping sliced meat and the like is disclosed in which a substantially ridged base is formed with a ridge which defines a target area for the location of a meat product thereon. The ridge is interrupted at at least one point about the periphery of the target area to provide a peripherally extending gap which extends to the surface of the platform on which the meat product is to be supported such that the full height of the product above the support platform can be ascertained visually through the gap in the ridge. A transparent wrapper encloses the product and seals the product with respect to the base.

3 Claims, 4 Drawing Figures

SHIPPER PACKAGE

This invention relates to a shipper package. Meat products such as sliced meat are frequently packaged on a rigid base and enclosed in a transparent flexible wrapper. Ridges or recesses are provided in the base for defining a target area for the location of the meat product. It has previously been suggested that it is important to provide a continuous ridge about the periphery of the target area to obtain an adequate seal for the flexible wrapper when a meat product is vacuum packed. In this respect reference is made to U.S. Pat. No. 3,229,810 in which it is indicated that the wrapper must extend around the upstanding convex rim, including the inner upwardly extending surface thereof. One major disadvantage to the use of a continuous rim is that it obscures the lowermost portion of the product. Thus, when the customer is examining the product and comparing it with a like product of the same weight packaged in a simple transparent wrapper, it may well appear that fewer slices of the product are provided in the package which is formed with the ridge because the ridge tends to obscure a portion of the product which is mounted on the platform. Furthermore, consumers are wary of packages in which a portion of the product is obscured from view.

We have found that all of the advantages to be derived from the provision of a ridge to define a target area of a package can be obtained with good visibility to the full depth of the product by making the perimeter ridge discontinuous so that gaps are provided at intervals about the periphery of the product through which the full height of the product is clearly visible. Contrary to the teachings of the prior art, we have found that a satisfactory seal between the flexible web and the base can be obtained without the need to extend the flexible web over a ridge formed in the base.

According to one aspect of the present invention, there is provided a shipper package comprising a substantially rigid base having a support platform thereon, a ridge projecting upwardly from the platform defining a periphery of product support area of the plaform, a product mounted on said product support area inwardly from said ridge and projecting above said ridge, said ridge being interrupted at at least one point about the periphery to provide a peripherally extending gap in the ridge which extends to the surface of the platform whereby the full height of the product above the support area can be ascertained visually through said gap, and a transparent wrapper enclosing the product and sealingly engaging the base.

The invention will be more clearly understood after reference to the following detailed specification read in conjunction with the drawings, wherein FIG. 1 is an exploded view of a shipper package constructed in accordance with an embodiment of the present invention;

Figure 1:
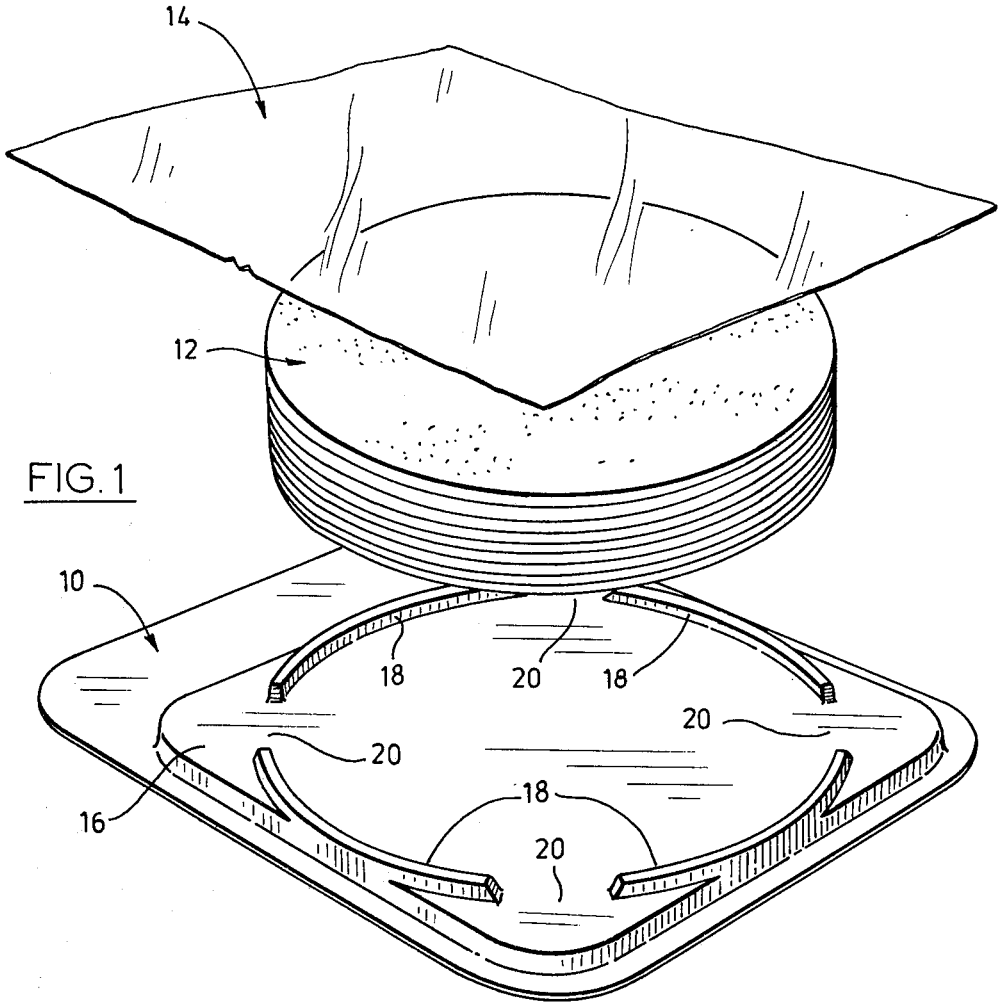

In FIG. 1 of the drawings, the reference numeral 10 refers generally to a substantially rigid base which is preferably made from a plastic material such as poly vinyl chloride. The reference numeral 12 refers generally to a cylindrical shaped product which consists of a plurality of slices stacked one on top of the other. The reference numeral 14 refers generally to a transparent flexible film which is preferably made from a plastic material such as polyethylene vinylidene chloride or the like.

The base 10 has a raised platform portion 16 from which arcuate shaped ridges 18 project upwardly to define the perimeter of a target area proportioned to receive the product 12 in a close fitting relationship. Gaps 20 are formed between spaced ends of the ridge sections 18.

Figure 2:
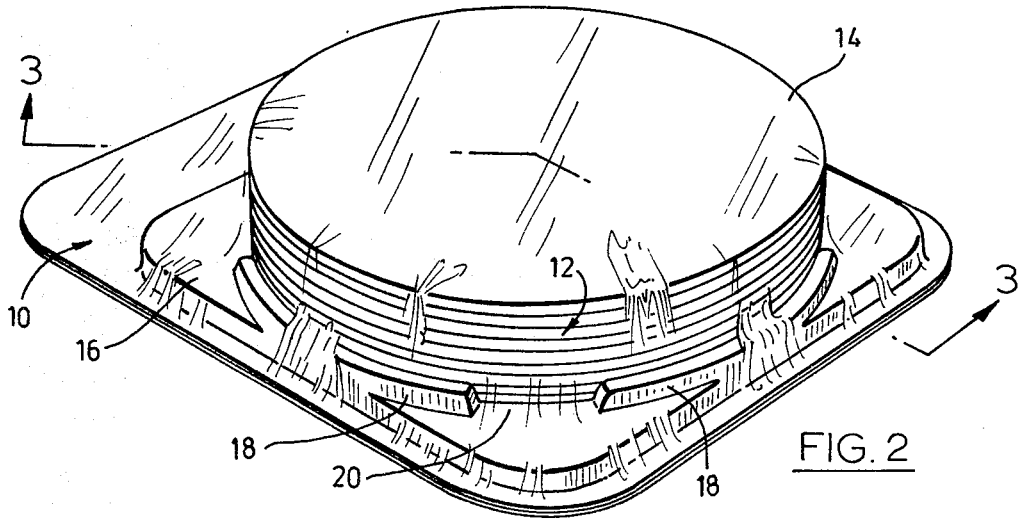
FIG. 2 is an assembled package formed from the elements of FIG. 1.
Figure 3:
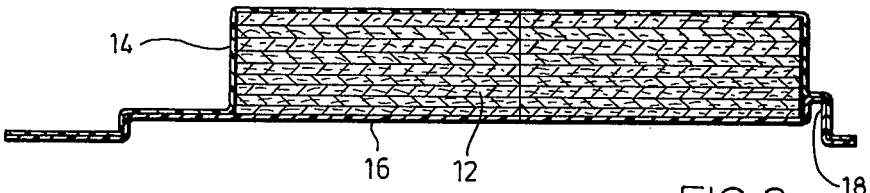
FIG. 3 is a sectional view along the line 3—3 of FIG. 2.

In use the product 12 is located on the platform 16 inwardly from the ridge 18 and the transparent wrapper is applied and vacuum sealed about the product and to the base 10 in a conventional manner, to assume the configuration shown in FIGS. 2 and 3 of the drawings. The full height of the product is visible through the gaps 20 which are formed in the perimeter of the ridge. Contrary to previous expectations, we have found that a very satisfactory seal can be obtained by conventional vacuum packing methods without the need to provide a continuous ridge about the perimeter of the target area.

Figure 4:
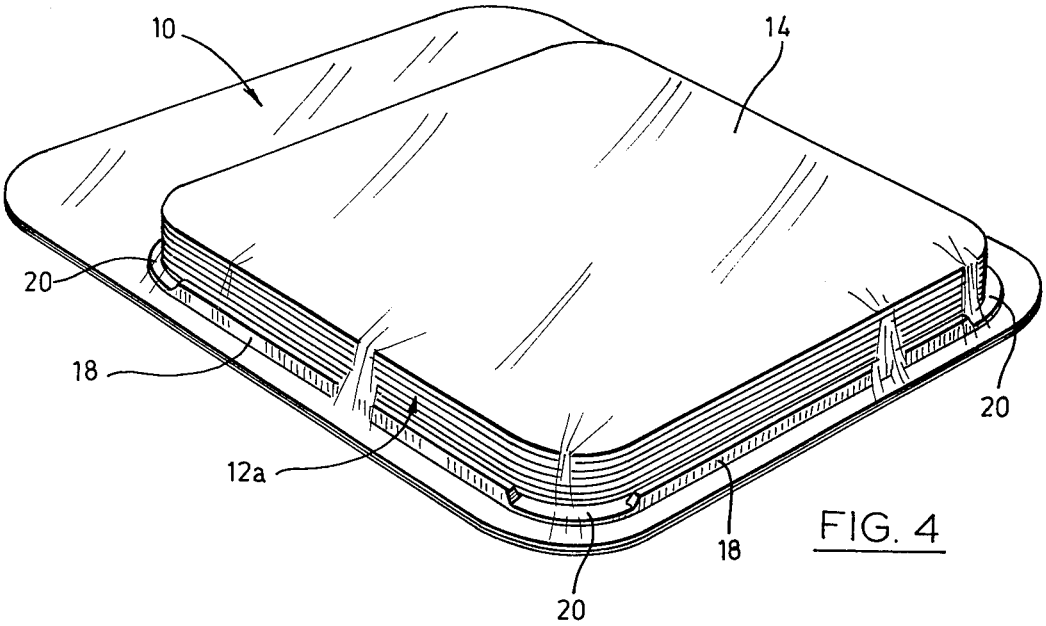
FIG. 4 is a pictorial view of an assembled package according to a further embodiment of the invention.

A further embodiment of the invention is illustrated in FIG. 4 of the drawings wherein the product 12*a* is of a rectangular configuration and the ridges 18 are provided at the corners of a rectangular perimeter. Again, the full height of the product is clearly visible through the gaps 20 formed between the ridges 18.

The product may be in the form of a sliced meat product such as bologna or ham or the like.

From the foregoing it will be apparent that the present invention provides a simple and inexpensive package in which the rigid base has a clearly defined target area on which the meat product may be positioned while the full height of the product remains visible so that the customer may have a clear indication of the total content of the package. These and other advantages of the present invention will be apparent to those skilled in the art.

What we claim as our invention is:

1. A shipper package comprising; a substantially rigid base having an upper face and a lower face, a support platform on the upper face projecting upwardly from said upper face and also being spaced inwardly from the circumferential edge around the entire periphery of the rigid base, a ridge projecting upwardly from the upper face of the platform defining a circumferential periphery of a product support area of the plaftorm, said ridge having an apex disposed above said upper face, a product mounted on said product support area inwardly from said ridge and projecting above said ridge, said ridge being interrupted at at least one point about the periphery to provide a peripherally extending gap in the ridge which extends to the surface of the platform whereby the full height of the product above the support area can be ascertained visually through said gap, said ridge being arranged and proportioned such that at least a portion of the ridge extends in each quadrant of the perimeter and a transparent vacuum-sealed wrapper enclosing the product and sealingly engaging the upper face of the base in a face to face relationship to form a continuous seal extending about the entire periphery outwardly from said apex of said ridge.

2. A shipper package as claimed in claim 1 wherein a plurality of gaps are formed in the ridge at spaced intervals therealong.

3. A shipper package as claimed in claim 1 or 2 wherein the product has a plurality of corners spaced about its periphery, and wherein a ridge section is provided so as to be coextensive with each corner to define a target area for positioning the product on the support platform.

* * * * *